United States Patent [19]

Bartolles

[11] Patent Number: 4,558,626

[45] Date of Patent: Dec. 17, 1985

[54] PRIMER CARTRIDGE MAGAZINE FOR A WEDGE-TYPE BREECH BLOCK

[75] Inventor: Rolf Bartolles, Korschenbroich, Fed. Rep. of Germany

[73] Assignee: Rheinmetall GmbH, Duesseldorf, Fed. Rep. of Germany

[21] Appl. No.: 531,428

[22] Filed: Sep. 12, 1983

[30] Foreign Application Priority Data

Sep. 11, 1982 [DE] Fed. Rep. of Germany ..... 3233749

[51] Int. Cl.[4] ..... F41F 13/12

[52] U.S. Cl. ..... 89/24; 42/1 B; 89/27.13

[58] Field of Search ..... 42/1 B, 7, 50; 89/24, 89/27.13

[56] References Cited

U.S. PATENT DOCUMENTS 2,569,995 10/1951 Kapsa ..... 42/1 B

FOREIGN PATENT DOCUMENTS 45561 4/1888 Fed. Rep. of Germany .
125978 5/1900 Fed. Rep. of Germany .
2231053 6/1972 Fed. Rep. of Germany .
2362131 12/1973 Fed. Rep. of Germany .
350555 4/1905 France .
488738 7/1918 France .
1268250 9/1959 France .

*Primary Examiner*—Stephen C. Bentley

[57] ABSTRACT

A primer cartridge magazine is removably mounted in the reciprocally movable slider of a wedge-type breech mechanism of a gun. The magazine has a longitudinal spring mounted therein which biases a stack of primer cartridges via a guide member towards the bottom of the magazine at which bottom a primer cartridge inlet and outlet is disposed. The magazine has a pair of parallel opposite walls which define a widened top portion having a pair of indicating windows. An indicating disc is rotatably mounted by means of a composite shaft in the widened portion and indicates via the indicating windows by means of a plurality of numbers disposed on each face of the indicating disc the stock of primer cartridges in the magazine. A tension band is connected to the indicating disc and guide member. A first locking mechanism locks the indicating disc against rotation when the magazine is not assembled in the slider. A second locking mechanism locks the indicating disc against rotation during loading of the magazine.

10 Claims, 10 Drawing Figures

PRIMER CARTRIDGE MAGAZINE FOR A WEDGE-TYPE BREECH BLOCK

BACKGROUND OF THE INVENTION

A primer cartridge magazine for a wedge-type breech block is known and is, for example, described in co-assigned U.S. Pat. No. 3,951,041. In order to fill such a primer cartridge magazine, which is in the shape of a shaft, with primer cartridges, it is necessary, to preload a spring 38. This requirement is met by either a pull rod projecting upwardly outside the ignition cartridge magazine 34, which pull rod serves simultaneously as an indicator, and which is firmly connected with the movable guide piece for the spring 38, or by means of a pressure rod which can be inserted from below through the bottom of a housing which can also be removed from below.

It has, however, been ascertained in practice that the pretensioning or pre-loading method by way of pull or pressure rods is very complicated, because only one hand of the person servicing the weapon is available for the post-loading, whereas the other hand is required to maintain the spring by means of the pull rod in a compressed position. While the pull rod has the advantage that, with its aid the stock condition of the available ignition cartridges in the magazine can be indicated, nevertheless the common indication method, for example, by means of colors, is insufficient to indicate the precise stock condition. A precise indication for a predetermined number of cartridges to be inserted is not possible with this state of the art arrangement. This state of the art arrangement has been found to be particularly disadvantageous with a filled ignition cartridge magazine having a pull rod which projects upwardly to an extent which is almost equal to the length of the magazine, because a correspondingly large free space, for example, between the roof of the turret or tower of an armored vehicle and the top of the wedge-type breech gun must be present, whereby, for example, the height of the armored vehicle is negatively influenced.

OBJECTS OF THE INVENTION

It is an object of this invention to provide an easily viewed and exact indication mechanism for indicating the number of primer cartridges in a gun having a wedge-type breech mechanism. The arrangement does not negatively influence the surrounding free space of the primer cartridge magazine, but is nevertheless space saving and permits a simple, secure and rapid operation of the loading process.

SUMMARY OF THE INVENTION

The invention makes it possible, by including a rotationally movable stored primer cartridge indication arrangement which is provided with a locking mechanism and a safety stop to eliminate or mitigate the drawbacks of the state of the art arrangements. The arrangement of the invention does not only provide exact storage indication for primer cartridges at opposite sides of the primer cartridge magazine, but also permits space saving without influencing adversely the surrounding space by means of a variable adjusting feature corresponding to the amount of the primer cartridges which are to be stored, and further provides for an easy and secure operation. The arrangement can, by means of a locking mechanism, effect by way of a simple rotational movement the indication of the amount of stored primer cartridge ammunition. This is effected by pretensioning a spring during the adjustment for a predetermined amount of primer cartridges to be received, whereby a simple rapid post-filling of primer cartridges is achieved without damaging them. When the locking mechanism is released by unloading the tension spring, the spring force prevents a falling out of the primer cartridges from the primer cartridge magazine and advantageously continuously indicates the available supply of primer cartridges. While the primer cartridge supply indicating arrangement requires a minor enlargement of the length of the primer cartridge magazine as a result of requiring a safety stop for overloading, compared to the primer cartridge magazine configuration will pull rod indicator, nevertheless there has been achieved considerable space savings, while maintaining the advantageous features of the prior art construction of the sliding in of the lower compartment portion of the primer cartridge magazine in the movable slider of the wedge-type breech block (see U.S. Pat. No. 3,951,041, co-assigned to the assignee of this application). Thus an exchangeable and space saving primer cartridge magazine having indication means for the primer cartridges stored therein has been conceived. This novel arrangement, when compared to the prior art primer cartridge magazine with pull rod, provides an additional free space corresponding almost to one full length of the primer cartridge magazine above the primer cartridge magazine, for example between the turret roof and the top of the wedge-type breech gun, which space is no longer required and thereby makes it possible to reduce the constructional height of the armored vehicle by this difference in height.

According to a special feature of the inventive arrangement, the stored primer cartridge indication means is provided with a locking mechanism and a safety stop that includes a rotatable round indicating disc. A pull band is form-lockingly connected to a guide member at one end and to the indicating disc at the other end. The arrangement further includes a wing nut. The indicating disc is rotatably arranged about the axis of the wing nut and is provided with form locking coupling discs forming a safety stop which is also mounted on the wing nut. A locking wheel and locking means can be coaxially mounted on the indicating disc. The pull band can also be wound around the indicating disc so that the arrangement achieves in the smallest possible space an adjustable and easily visible storage indicating means.

It has been found to be of particular advantage to make the indicating disc of a reduced specific weight, for example of a light material having a specific weight of less than 3000 kg/m$^3$, such disc favorably influences the fatigue limit of the pull band, because, during expulsion of the primer cartridges from the primer cartridge magazine and the concomitant further rotation of the indicating disc causes only a reduced swing moment needs to be transferred. The so further reduced swing mass of the indicating disc which is to be braked before indicating an empty condition result, makes it possible for the coupling discs of the safety stop to be dimensioned correspondingly small thereby providing an increased useful life, without failing to consider the additional object, to wit, to indicate an overloaded safety condition of the pull band during an impacting of a coupling disc at the safety stop at maximum pretensioning of the spring. The inventive arrangement has the further advantageous feature in that the distances between the sprocket teeth of the sprocket locking wheel correspond in such a way to the distances between the primer cartridges in the primer cartridge magazine and the numbers on the indicating disc that in the indicating windows either the preselected number of the indicating disc or the number of the prevailing amount of stored cartridges is easily and clearly visible.

BRIEF DESCRIPTION OF THE DRAWING

The above and other objects, features and advantages will become more readily apparent from the following description with reference to the accompanying drawing in which.

DETAIL DESCRIPTION

Figure 1:
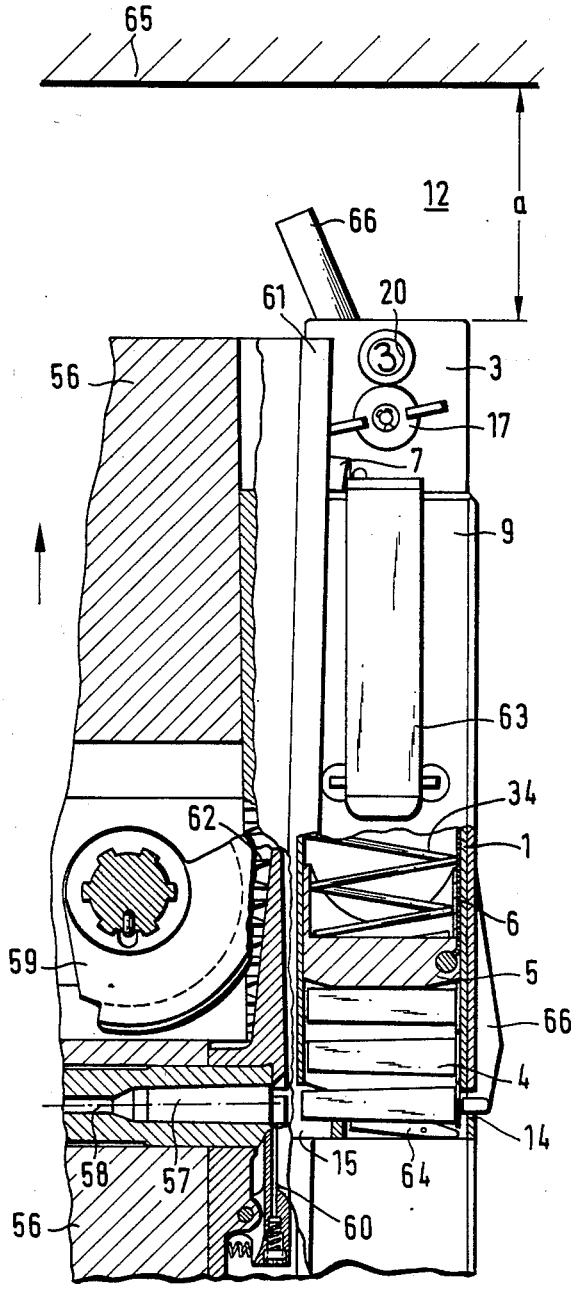
FIG. 1 illustrates schematically a partial sectional view through the wedge-type breech block disposed in the firing position at a non-illustrated gun barrel at the level of the gun barrel axis with a locked breech block having a primer cartridge magazine slid into a slider.

In FIG. 1 there is illustrated a sliding wedge-type breech block 56, movable in the direction of the arrow in the breech portion of a gun, for purposes of introducing a new primer cartridge 4 into the primer cartridge receiving chamber 57 which, at firing, is coaxially disposed with respect to the gun barrel axis 58 of the non-illustrated gun barrel. In the breech block 56 there is rotatably mounted a toothed pinion segment 59. A guide 61, arranged on the breech block 56, serves to slidably reciprocally guide a slider 9, which is operatively movable by means of a toothed rack 62. The toothed pinion segment 59 is, after firing, swingable in a clockwise direction downwardly, so that the slider 9 also moves downwardly oppositely relative to the breech block movement. There is rotatably mounted on the slider 9 a loading lever 66 by means of which the primer cartridges 4 are automatically or manually slid into the primer cartridge chamber 57. Below the primer cartridge chamber 57 there is operatively mounted a crank-lever-like extraction claw 60.

The primer cartridge magazine 1 is mounted within the slider 9 by means of a snap detent 63. An indicating window 20 indicates the amount of primer cartridges 4 which are stored in the primer cartridge magazine 1. In this assembled position a locking mechanism 7 is not in engagement with the storage indicating arrangement 3, which locking mechanism 7 is disposed opposite to that end of the primer cartridge magazine 1 at which the ejection opening 15 and the insertion opening 14 are disposed. Thereby, the primer cartridges 4 are pressed, under pressure of the magazine spring 34, against the rocker stop 64 via a guide member 5. A tension band 6 is provided forming a tension connection between the storage indicating arrangement 3 and the guide member 5 so that a precise count indication of the primer cartridge 4 which are still stored in the primer cartridge magazine 1 can be provided, which indication can be seen in the front and the oppositely disposed rear indicating window 20.

Below the indicating window 20 there is arranged on the storage indicating arrangement 3 a wing nut 17, by means of the rotation of which during a period subsequent to the loading of the primer cartridge magazine 1 the magazine spring 34 is spacesavingly pretensioned by means of the guide member 5 via the tension band 6. The primer cartridges 4 which can easily be subsequently loaded are removed via the insertion opening 14 by releasing or loading the spring force until a predetermined amount, preadjusted by the wing nut 17, has been loaded. For this reason, when the primer cartridge magazine 1 is slid again into the slider 9, the space 12 disposed above the storage indicating arrangement 3 is not negatively influenced by the indicating mechanism, so that for example, between the turret roof 65 of an armored vehicle and the primer cartridge magazine 1 the distance a can be held to a minimum.

Figure 2:
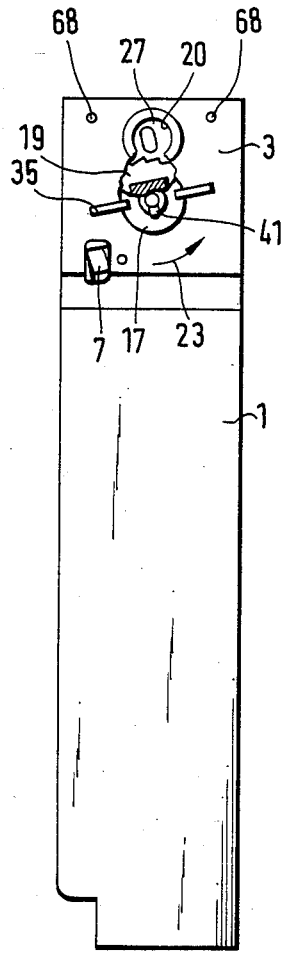
FIG. 2 is a front elevational view of the primer cartridge magazine of this invention with a stock condition indicating arrangement.
Figure 3:
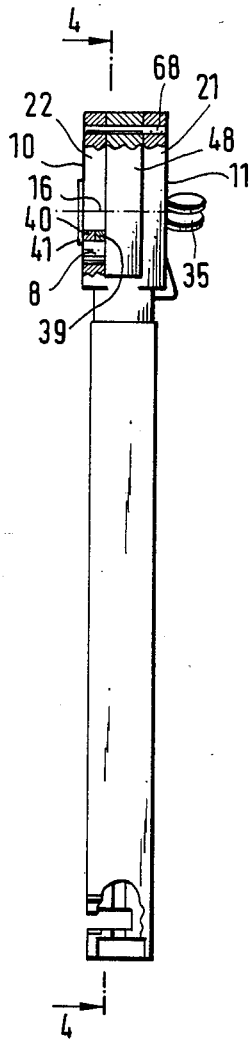
FIG. 3 is a left side elevational view of the primer cartridge magazine of FIG. 2.
Figure 4:
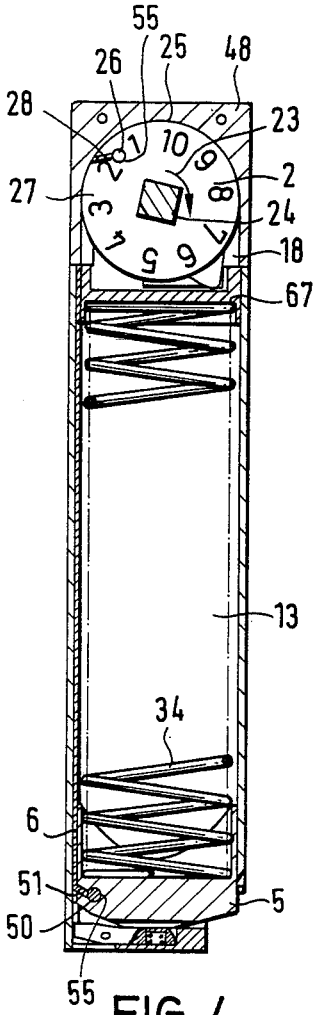
FIG. 4 is a longitudinal sectional view through the primer cartridge magazine along the plane 4—4 of FIG. 3.

FIGS. 2–4, incl., illustrate the primer cartridge magazine 1 in different positions. Without significantly lengthening the primer cartridge magazine 1, the housing walls 21, 22 of the storage indicating arrangement 3 merge into the side walls of the housing of the primer cartridge magazine 1 also without substantially changing the overall width thereof. The wing nut 17 is rotatably mounted in the housing walls 21, 22 about the axis 16. The indicating disc 2 and a locking wheel 19 of the locking mechanism 7 are received in a widened portion 18 of the magazine shaft 13 and are coaxially mounted therein as will be described hereinbelow via a profiled opening 24. There are disposed on the wing nut 17 on the side 11, for comfortably pretensioning the magazine spring 34, two oppositely disposed narrow wings 35 which are mounted in a plane that is normal to the longitudinal axis of the primer cartridge magazine 1. By rotating the fly wheel 17 the spring 34 can be pretensioned. This does not effect, in the indicating window 20, a rotation of the indicating disc 2 and locking wheel. Within the housing wall 22 the discs 39, 40 are form-lockingly and coaxially connected to the wing nut 17, which discs are mutually movable and serve as a safety stop 8. The wing nut 17 and the discs 39, 40 are axially fixed by means of fixing means 41. By rotating the wing nut 17 in the direction of the arrow 23, the magazine spring 34 is pretensioned in the magazine shaft 13 via the tension band 6, which tension band has one of its ends connected via a cylinder 55 to the indicating disc, which is inserted in a slit 28 and a bore 26 on the indicating disc, and on the other end in a similaar manner via slit 51 with the bore 50 of the guide member 5, thereby being form lockingly connected to the respective members. Thereby the locking mechanism 7 can assume any stop position up to the limit of the rotation effected by the safety stop 8 by engaging the corresponding teeth of the locking wheel 19. The numerical indicia of the end faces 27 of the indicating discs 2 serve to indicate in the indicating windows 20, in a rotational direction opposite to the rotational direction 23, at both windows, either during the loading process the number of the to-be-loaded primer cartridges 4, or in the assembled condition of the primer cartridge magazine 1 in the slider 9, the amount of stored primer cartridges 4 after firing. The guide member 67, which serves for receiving the magazine spring 34, biases upwardly against the receiving member 48, which member is connected with the housing walls 21, 22 by means of pins 68. This arrangement presents a secure guiding for the tension band 6 and also provides an exterior protective cover 25 for the indicating disc 2.

Figure 5:
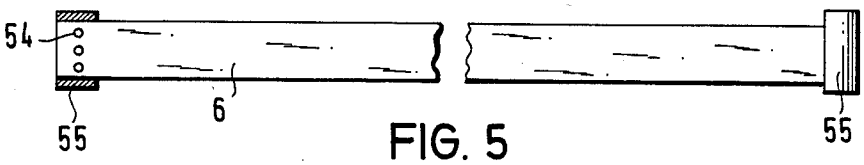
FIG. 5 is a partial plan view of the tension band with fastening elements disposed at opposite ends.

FIG. 5 illustrates clearly the tension band 6, armed at both of its ends with cylinders 55 for form-lockingly coupling the tension band 6 at both of its ends, and thereby to load it transversely to the longitudinal direction of the respective bores 50 and 26. The base 55 can be securely attached to the tension band 6 by way of transverse pins 54 which can, for example, be made out of synthetic material that is weldable, pressable or injection moldable on the band 6.

Figure 6:
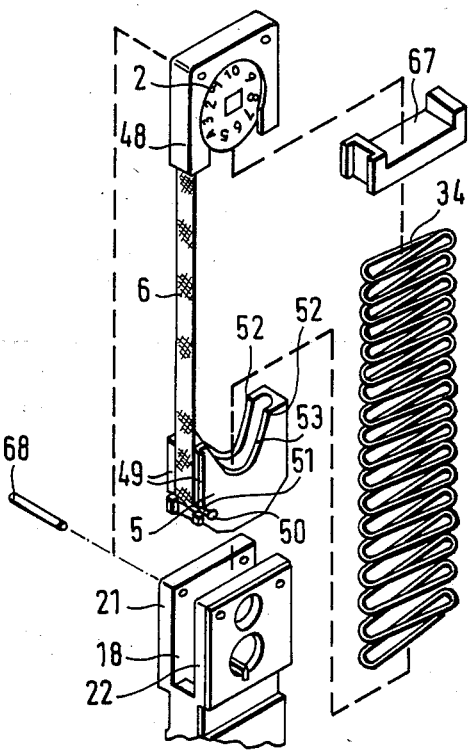
FIG. 6 is a perspective explosive view of the parts of the indicating arrangement which are to be mounted and assembled in the primer cartridge magazine and of a spring with indication as to how it is to be assembled in the magazine.

FIG. 6 illustrates those parts which are jointly slidable into the widened portion 18 of the magazine shaft 13 (FIG. 4), such as the guide member 5, the magazine spring 34, the tension band 6, the guide member 67 as well as the receiving member 48 which is fixable by means of pins 68 onto the housing walls 21, 22. The central bore of the receiving member 48 is open towards the widened shaft portion 18 but does otherwise semicircularly protectively surround the indicating disc 2. The guide member 5 includes, for guiding and fixing the tension band 6, a groovelike guide slot 49, a slit 51 and a bore 50. The shanks 52 of the guide member 5 are configured somewhat high in order to provide a good guidance and include, rounded portions 53, in order to prevent, on the one hand, a clamping of the magazine spring 34 and, on the other hand, make for a reduced movable mass.

Figure 7:
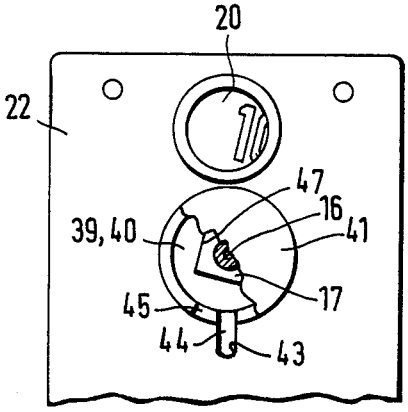
FIG. 7 is a partial side elevational view from the left of the indicating arrangement illustrated in FIG. 3.

The construction of the safety stop 8 assembly (FIG. 3) is illustrated at an enlarged scale in FIG. 7. The discs 39, 40 are rotatably mounted within the housing wall 22 below the indicating window 20 and are rotatable about the axis 16. The segment 45 of the disc 39, at maximum pretensioned magazine spring 34, prevents a further rotation of the wing nuts 17 by means of a stop 44 which at that point is biased into the groove 43. The end piece 38 of wing nut 37 form-lockingly engages into mating opening 47 of disc 40. The segments 46 (FIG. 10) of the discs 39, 40 are dimensioned in such a way for the purpose of forming the necessary coupling, that even with an empty primer cartridge magazine 1 and an unloaded magazine spring 34 (FIG. 4), a further rotation counter to the rotational direction 23 (FIG. 4) is prevented. The disc 40 is maintained in the longitudinal direction of the axis 16 from the outside by fixing means 41, for example a disc to which a pin is connected.

Figure 8:
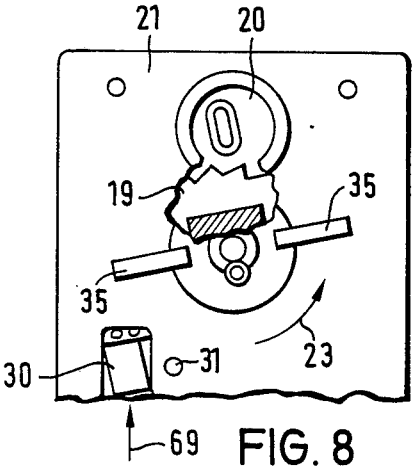
FIG. 8 is a partial side elevational view from the right of the indicating arrangement illustrated in FIG. 3.

FIG. 8 illustrates at an enlarged scale the position of the lever 30 of the locking mechanism 7 (FIG. 1) and also indicates how the locking wheel 19 is arranged in the housing wall 21 relative to the indicating window 20 in a most compact space. By means of the assembling of the primer cartridge magazine 1 into the slider 9 (FIG. 1) there can be released by a movement of the lever 30 in the direction of the arrow 69 the blocking of the locking wheel 19, so that a return rotation counter to the rotational direction of the arrow 23 is now possible.

Figure 9:
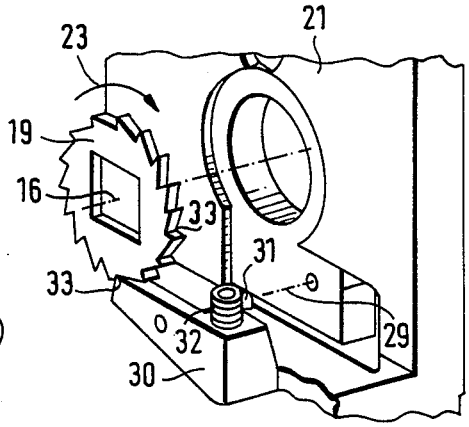
FIG. 9 is a perspective view of the individual parts of the locking mechanism indicating also the assembled position on the inner side of the primer cartridge magazine.

As the lever 30 lockingly engages into the tooth gaps 33 of the locking wheel 19, rotatably mounted about the axis 16, the automatic return motion into a locking position results, which is clearly illustrated in detail in FIG. 9. When removing the primer cartridge magazine 1 from the slider 9 (FIG. 1) for example during a magazine exchange, the lever 30 is pivoted about a pin 31 about the axis 29 under pressure of the return spring 32 so that the free end of the lever 30 now meshes into the tooth gaps 33 of the locking wheel 19.

Figure 10:
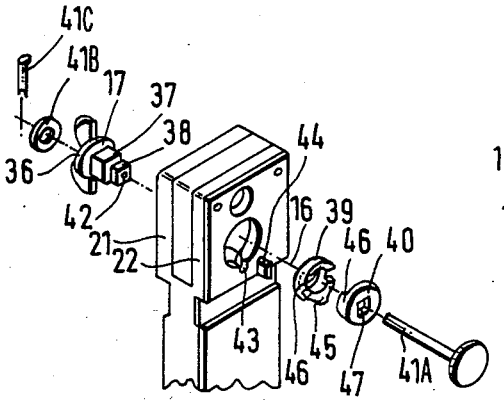
FIG. 10 is an explosive perspective view of those parts which are mounted along the axis of the indicating arrangement in the sequence in which they are being assembled.

FIG. 10 illustrates in detail all of the individual elements that are mounted along axis 16 in the same sequence in which they are assembled from the outside into the housing wall 21 and 22. There is recognizable at the wing nut 17 adjacent to the cylindrical base 36, which serves for centering in the housing wall 21, the square profile-shaped middle wing nut projection 37, on which the indicating disc 2 is mounted and the also square profile-shaped end piece 38, for form-locking mating entrainment of the discs 39, 40. A throughbore 42 permits the fixing in the axial direction via the fixing means 41 (as can be seen in FIG. 10 the fixing means consist of a pin 41A, a washer 41B and a Cotter pin 41C) of the entire assembly. The segments 46 of the discs 39, 40 which intermesh as a coupling and assume the rotational movement transferred by the profiled opening 47 of the disc 40 and are by way of play, that is available in the peripheral direction, adjusted to the limited rotational movement of the wing nut 17 by way of the stops of the segments 45.

Although the invention is described and illustrated with reference to a plurality of embodiments thereof, it is to be expressly understood that it is in no way limited to the disclosure of such preferred embodiments but it capable of numerous modifications within the scope of the appended claims.

We claim:

1. In a gun having a wedge-type breech mechanism and a reciprocally movable slider, a primer cartridge magazine operatively movable in said slider, said primer magazine comprising in combination, biasing means operatively mounted in said magazine for biasing a stack of primer cartridges stored therein;

said magazine has a pair of opposite parallel walls on which a stock primer cartridge indicia means is rotatably mounted;

a guide member is slidably movably mounted in said magazine between said pair of opposite parallel walls and is urged by said biasing means against said stack of primer cartridges;

a tension band has one of its ends connected to said guide member and the other end connected to said stock primer cartridge indicia means;

first releasable locking means operatively mounted in said magazine so as to selectively move between a locking first position and a second releasing position, said first locking means automatically releasing said stock primer cartridge indicia means when being disposed in said second position and automatically locking said stock primer cartridge indicia means when being disposed in said first position, said first locking means assuming said second position when said magazine is in assembled state in said slider; whereby the stock of primer cartridges is continuously indicated in said magazine;

said biasing means including second releasable locking means for deactivating the biasing during loading of primer cartridges into said magazine;

said stock primer cartridge indicia means including a stop for preventing an overloading of said stock primer cartridge indicia means.

2. In a gun having a wedge-type breech mechanism and a reciprocally movable slider, the primer cartridge magazine as set forth in claim 1, wherein said magazine includes a widened top portion and said stock primer cartridge indicia means includes an indicating disc which is operatively mounted in said widened top portion, said pair of opposite parallel walls including a pair of opposite indicating windows in said widened top portion through which said indicia means is adapted to indicate the stock of primer cartridges in said magazine, said magazine also includes a bottom portion disposed at the end remote from the said top portion, said bottom portion having a primer cartridge inlet and outlet for respectively loading primer cartridges into said magazine and discharging cartridges therefrom; shaft means rotatably mounted in said opposite pair of parallel walls in said widened top portion, said indicating disc being coaxially removably but non-rotatably mounted on said shaft means in said widened portion; a wing nut being coaxially removably mounted on said shaft means outside of said widened portion;

said tension band being form-lockingly connected at one of its ends to said indicating disc and at the other one of its ends to said guide member; a holder member mounted in said widened portion and having a circular recess, said indicating disc being mounted in said circular recess; said first locking means including a ratchet wheel coaxially mounted on said shaft means in said widened portion and being form-lockingly connected to said wing nut so as to rotate jointly therewith.

3. In a gun having a wedge-type breech mechanism and a reciprocally movable slider, the primer cartridge magazine as set forth in claim 2, wherein (a) said indicating disc has a pair of opposite indicating faces, each face has a plurality of consecutive numbers equidistantly disposed thereon in a directional sequence which is opposite to the rotational direction of said indicating disc; the total number of numbers corresponds to the maximum number of primer cartridges storable in said magazine;

(b) a first bore of non-circular cross-section axially extends through said indicating disc; said wing nut having an axially projecting shaft portion for matingly engaging into said first bore which shaft portion forms part of said shaft means;

(c) said indicating disc having a second bore and slot extending normally therethrough adjacent to its outer periphery, said tension band having one of its free ends matingly engage in said second bore to thereby form-lockingly connect said tension band to said indicating disc.

4. In a gun having a wedge-type breech mechanism and a reciprocally movable slider, the primer cartridge magazine as set forth in claim 3, wherein said indicating disc has a reduced moment of inertia and is made of a light material having a specific weight of less than 3000 $kg/m^3$.

5. In a gun having a wedge-type breech mechanism and a reciprocally movable slider, the primer cartridge magazine as set forth in claim 4, wherein said first locking means includes a lever pivotally mounted in said widened portion of said magazine, one end of said lever selectively engaging said ratchet wheel, a coil spring operatively mounted in said magazine and engaging said lever so as to lockingly bias it against said ratchet wheel; said ratchet wheel having a plurality of equidistantly disposed ratchet teeth; the distances between the primer cartridges in the magazine, the distances between the numbers on the indicating disc, and the distances between the teeth of the ratchet wheel being such that there is indicated through the indicating windows either the preselected number of the indicating disc or the available amount of primer cartridges.

6. In a gun having a wedge-type breech mechanism and a reciprocally movable slider, the primer cartridge magazine as set forth in claim 5, wherein said wing nut has a pair of wings which can be manually grasped to rotate said indicating disc via said projecting shaft portion and first bore of non-circular cross-section to thereby pretension said biasing means via said tension band and guide member; said axially projecting shaft portion including (a) a cylindrical portion which is rotatingly mounted in a third bore in one of said walls of said pair of opposite parallel walls;

(b) a middle portion adjoining said cylindrical portion;

(c) and end portion adjoining said middle portion; said end portion is form-lockingly engaged to a pair of coaxial discs for coacting with said second locking means;

(d) said cylindrical portion, middle portion and end portion being coaxially aligned and having a third bore axially extending therethrough; and (e) fixing means axially extending through said third bore for holding said portions a, b, and c together in an assembled condition.

7. In a gun having a wedge-type breech mechanism and a reciprocally movable slider, the primer cartridge magazine as set forth in claim 6, wherein said second releasable locking means includes a groove disposed in the parallel wall of said pair of parallel walls which is remote from said fly wheel, a second coil spring mounted in said groove, said pair of coaxial discs form-lockingly engage each other, a first one of said pair of coaxial discs having a projection which is engaged by said second coil spring in said groove, said end portion of said axially projecting shaft portion form-lockingly engages a second one of said pair of coaxial discs, said second coil spring engaging said projection in opposite respective directions either when said magazine has been stocked with said maximum number of primer cartridges or when said magazine is completely empty.

8. In a gun having a wedge-type breech mechanism and a reciprocally movable slider, the primer cartridge magazine as set forth in claim 7, wherein said pair of coaxial discs have mutual confronting faces, mutually engaging form-locking means respectively disposed on each face of said confronting faces, at least one disc of said pair of coaxial discs including a non-circular axial bore, said end portion being non-cylindrical and form-lockingly engages in said non-circular axial bore of said one disc.

9. In a gun having a wedge-type breech mechanism and a reciprocally movable slider, the primer cartridge magazine as set forth in claim 8, wherein said guide member includes a guide slot in which said tension band is guided, said guide member further includes a third bore and a slot normally extending therethrough, said tension band having the other one of its free ends matingly engage in said third bore to thereby form-lockingly connect said tension band to said guide member, said biasing means including a spring, and said guide member having curved walls defining a pocket for receiving said spring.

10. In a gun having a wedge-type breech mechanism and a reciprocally movable slider, the primer cartridge magazine as set forth in claim 9, wherein said form-locking connections of said tension band respectively to said indicating disc and said guide member is effected by each end of said tension band having a cylinder secured thereto at opposite ends transversely with respect to the longitudinal axis of the tension band, said cylinders respectively matingly fitting into said second and third bores.

* * * * *